US009033165B2

(12) United States Patent
Aus et al.

(10) Patent No.: US 9,033,165 B2
(45) Date of Patent: May 19, 2015

(54) CRANE ASSEMBLY

(75) Inventors: Kelvin G. Aus, Garner, IA (US); Bradley G. Ethington, Rudd, IA (US)

(73) Assignee: Oshkosh Corporation, Oshkosh, WI (US)

( * ) Notice: Subject to any disclaimer, the term of this patent is extended or adjusted under 35 U.S.C. 154(b) by 494 days.

(21) Appl. No.: 13/024,204

(22) Filed: Feb. 9, 2011

(65) Prior Publication Data

US 2012/0199544 A1 Aug. 9, 2012

(51) Int. Cl.
*B66C 23/42* (2006.01)
*B66C 23/70* (2006.01)
*B66C 23/64* (2006.01)

(52) U.S. Cl.
CPC ..... *B66C 23/701* (2013.01); *B66C 23/64* (2013.01)

(58) Field of Classification Search
CPC B66C 23/44; B66C 2700/0357; B66C 23/34; B66C 23/344; B66C 23/36
USPC ..... 212/180, 295, 296, 299, 300, 306
See application file for complete search history.

(56) References Cited

U.S. PATENT DOCUMENTS

| | | | | | |
|---|---|---|---|---|---|
| 271,484 | A | | 1/1883 | Limeburner | |
| 275,689 | A | * | 4/1883 | Mitchell | 212/295 |
| 2,157,376 | A | | 5/1939 | Zeilman | |
| 2,292,353 | A | * | 8/1942 | Ennis et al. | 212/176 |
| 3,249,238 | A | | 5/1966 | Hedeen | |
| 3,481,490 | A | | 12/1969 | Eiler | |
| 3,690,742 | A | | 9/1972 | Sung | |
| 3,708,937 | A | | 1/1973 | Sterner | |
| 3,710,950 | A | * | 1/1973 | Pottorff et al. | 212/294 |
| 3,759,399 | A | * | 9/1973 | Glass et al. | 212/180 |
| 3,778,855 | A | * | 12/1973 | Kariagin et al. | 114/375 |
| 3,888,368 | A | * | 6/1975 | Hawkins | 414/563 |
| 3,985,234 | A | | 10/1976 | Jouffray | |
| 4,038,794 | A | * | 8/1977 | Young | 52/127.5 |
| 4,091,935 | A | | 5/1978 | Whittingham | |
| 4,099,628 | A | * | 7/1978 | Richardson | 212/280 |
| 4,171,597 | A | | 10/1979 | Lester et al. | |
| 4,281,487 | A | | 8/1981 | Koller | |
| 4,318,488 | A | | 3/1982 | Rathi | |
| 4,459,786 | A | * | 7/1984 | Pitman et al. | 52/115 |
| 4,579,235 | A | * | 4/1986 | Orwig | 212/294 |
| 4,700,851 | A | * | 10/1987 | Reeve et al. | 212/181 |
| D301,127 | S | * | 5/1989 | Lindblom | D12/14 |
| 4,881,864 | A | * | 11/1989 | Amato | 414/543 |
| 5,402,898 | A | * | 4/1995 | Lute | 212/255 |
| 5,609,261 | A | | 3/1997 | Hensler | |
| 5,711,440 | A | * | 1/1998 | Wada | 212/278 |
| 6,095,349 | A | * | 8/2000 | O'Meara | 212/180 |
| 6,138,991 | A | * | 10/2000 | Myers, Jr. | 254/323 |
| 6,481,587 | B2 | * | 11/2002 | Higgins | 212/298 |
| 7,156,246 | B2 | * | 1/2007 | Sherrod | 212/180 |
| 7,172,082 | B2 | | 2/2007 | Irsch et al. | |

(Continued)

*Primary Examiner* — Emmanuel M Marcelo
*Assistant Examiner* — Michael Gallon
(74) *Attorney, Agent, or Firm* — Foley & Lardner LLP

(57) ABSTRACT

A crane assembly includes a main body, a boom extending from the main body, a cable, and a hook coupled to an end of the boom opposite to the main body by the cable, where the crane assembly is configured for lifting items via the hook. The crane assembly further includes a projection extending outward from the boom and curving toward the main body. The projection is configured to receive the hook over an end of the projection such that tension in the cable maintains the hook in place on the projection. Gravity is sufficient to release the hook from the projection when the boom is raised and the tension in the cable is released.

12 Claims, 13 Drawing Sheets

(56) References Cited

U.S. PATENT DOCUMENTS 7,201,552 B1 * 4/2007 Angel et al. ..... 414/462
7,845,622 B1 * 12/2010 Riggs ..... 254/326
2006/0054580 A1 * 3/2006 Sherrod ..... 212/180
2008/0164233 A1 7/2008 Schroeder et al.
2010/0295005 A1 * 11/2010 Riggs ..... 254/326

* cited by examiner

CRANE ASSEMBLY

BACKGROUND

The present disclosure relates generally to the field of cranes and other lifting machines designed to raise, lower, load, unload, or otherwise move cargo, materials, and other items.

A crane typically includes a main body or platform and a boom extending from the main body. The main body may be fixed or mobile. The boom supports a cable, which may be formed from metal wire, chains, rope, or other materials. A hoist or winch is used to wind and unwind the cable. The crane further includes a hook or other tool hanging from the end of the boom opposite to the main body by the cable. The hook is generally used to attach cargo, materials, or other items to the cable of the crane. Some cranes include a hook or other tool fastened to a rigid post or section, without a cable.

The sizes, loads, and forms of cranes vary widely. In some cases, the boom includes stages of extensions that slide telescopically from one another. The number of stages varies, and may include a main section with two extensions, or many more than two extensions. In other cases, the boom includes a jib pivotally fastened to an end of the boom, to increase the length of the boom. The jib may also include telescoping sections. In still other cases, the boom extends from the main body of the crane by way of an articulated arm that maneuvers the boom.

SUMMARY

One embodiment of the invention relates to a crane assembly, which includes a main body, a boom extending from the main body, a cable, and a hook coupled to an end of the boom opposite to the main body by the cable, where the crane assembly is configured for lifting items via the hook. The crane assembly further includes a projection extending outward from the boom and curving toward the main body. The projection is configured to receive the hook over an end of the projection such that tension in the cable maintains the hook in place on the projection. Gravity is sufficient to release the hook from the projection when the boom is raised and the tension in the cable is released.

Another embodiment of the invention relates to a crane assembly, which includes a main body, a boom projecting from the main body, and a rest. The boom is adapted to be extended and raised to an operational configuration, and to be retracted and lowered to a storage configuration. The rest is coupled to the main body and is configured for receiving the boom and supporting the boom in the storage configuration. If the boom is lowered further than necessary to be received by the rest, the rest is configured to absorb downward force of the boom, mitigating damage to the main body of the crane assembly.

Yet another embodiment of the invention relates to a rest configured to be mounted to a main body of a portable crane assembly to support a boom of the portable crane assembly. The rest includes a base, a column, and a seat. The base is configured to absorb force from the boom by deforming when loaded vertically downward if the boom is lowered further than necessary to be received by the rest, mitigating damage to the main body of the portable crane assembly. The column is coupled to the base, and the seat is coupled to an end of the column and is configured to receive the boom.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
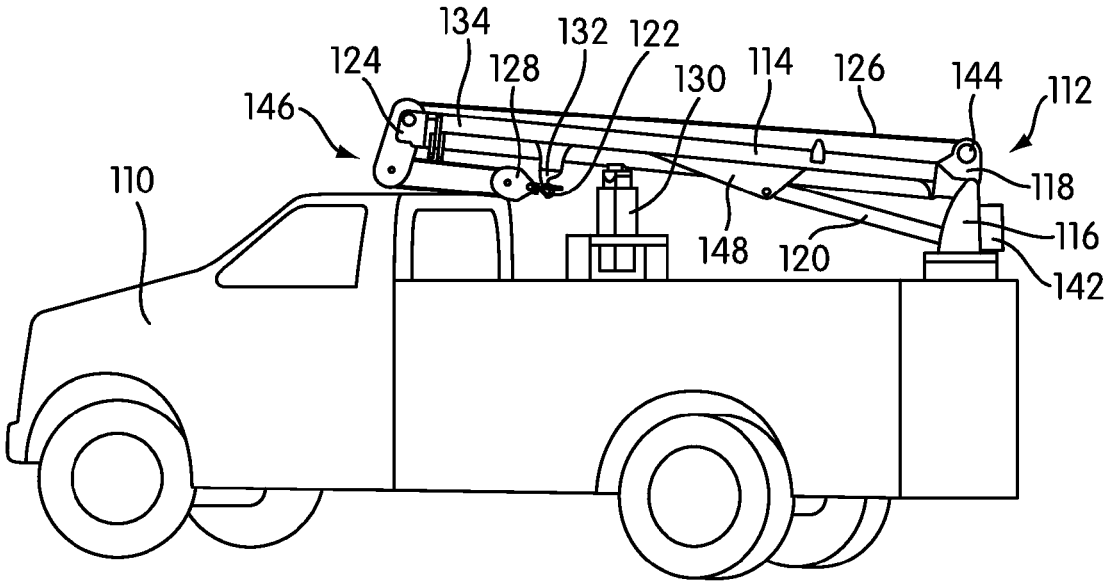
FIG. 1 is perspective view of a utility vehicle having a telescoping crane in a first configuration according to an exemplary embodiment of the invention.

Referring to FIG. 1, a utility vehicle 110, such as mobile crane or mechanics truck, includes a crane assembly 112. The crane assembly 112 includes a boom 114 extending from a main body in the form of a mast 116 of the crane assembly 112 coupled to the chassis of the utility vehicle 110. The boom 114 is coupled to the mast 116 by way of a pivot 118 (e.g., fulcrum, joint, pin), allowing to the boom 114 or mast 116 to rotate about a vertical axis generally orthogonal to the chassis of the utility vehicle 110.

According to an exemplary embodiment, an actuator (not shown) in or coupled to the mast 116, such as an electric or hydraulic motor driving a planetary- or worm-gear set, is configured to rotate the boom 114 or the mast 116 relative to the main body of the utility vehicle 110. An actuator 120, such as a linear actuator or hydraulic cylinder (e.g., "main cylinder") extending between the boom 114 and the mast 116, is configured to raise and lower the boom 114 in a controlled manner by increasing or decreasing the angle of the boom 114 about the pivot 118 relative to a horizontal axis generally coplanar with the chassis of the utility vehicle 110.

According to an exemplary embodiment, the crane assembly 112 further includes a hook 122 coupled to an end 124 of the boom 114 opposite to the mast 116 by way of a cable 126. The hook 122 is maneuverable by moving the utility vehicle 110, rotating the boom 114, raising or lowering the boom 114, and winding or unwinding the cable 126. In some embodiments, the hook 122 is fastened to a block 128 (e.g., snatch block) having one or more sheaves for a pulley system that provides a mechanical advantage as the cable 126 raises and lowers the block 128. The hook 122 generally forms a loop upon which items, fasteners, or the cable 126 itself may be configured to fasten cargo, construction materials, or other items to the crane assembly 112, in order to move the items. In other contemplated embodiments, the crane assembly 112 includes a loop, a ball, chains, a platform (e.g., "cherry-picker" type crane), a sprayer, or other tools coupled to the end 124 of the boom 114.

The crane assembly 112 in FIG. 1 is shown in a storage configuration, with the boom 114 lowered and retracted, supported by a rest 130 (e.g., boom support, stand, seat, post). The hook 122 is stored on a projection 132 extending from the underside of the boom 114. In the storage configuration, the utility vehicle 110 is configured to drive the crane assembly 112 to or from a worksite, where the crane assembly 112 may be converted to an operational configuration.

Figure 2:
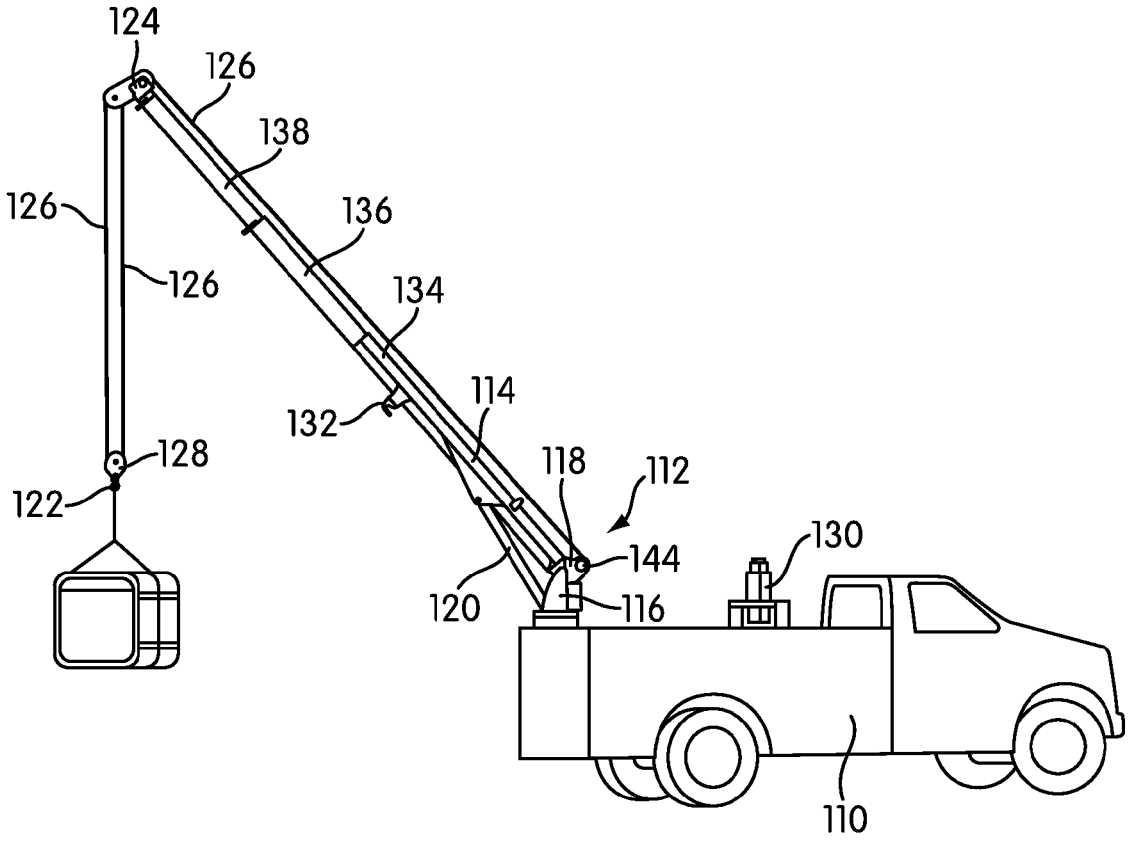
FIG. 2 is a perspective view of the utility vehicle of FIG. 1 with the telescoping crane in a second configuration.

Referring now to FIG. 2, the crane assembly 112 is shown in an operational configuration. According to an exemplary embodiment, the boom 114 includes a main section 134 (e.g., main boom) and first- and second-stage extensions 136, 138. The first-stage extension 136 is configured to telescope outward from the main section 134, and the second-stage extension 138 is configured to telescope outward from the first-stage extension 136. Linear actuators, such as hydraulic cylinders (not shown), which may be located internal to the sections 134, 136, 138, slide the first-stage extension 136 relative to the main section 134 and the second-stage extension 138 relative to the first-stage extension 136. In contemplated embodiments, the crane assembly includes additional or fewer stages of telescoping extensions. In the operational configuration shown in FIG. 2, the boom 114 of the crane assembly 112 is at least partially extended or raised from the rest 130.

In contemplated embodiments, a crane assembly may include a boom and hook, but not a mast or a cable. In some such embodiments, the boom is pivotally coupled to a main body other than a mast, such as a fixed platform or rig. In other such embodiments, the boom may be configured to be raised an lowered about a pinned pivot, but not rotated about a vertical axis. The apparatus of the present invention is not limited to a particular type of crane or boom configuration.

Figure 3:
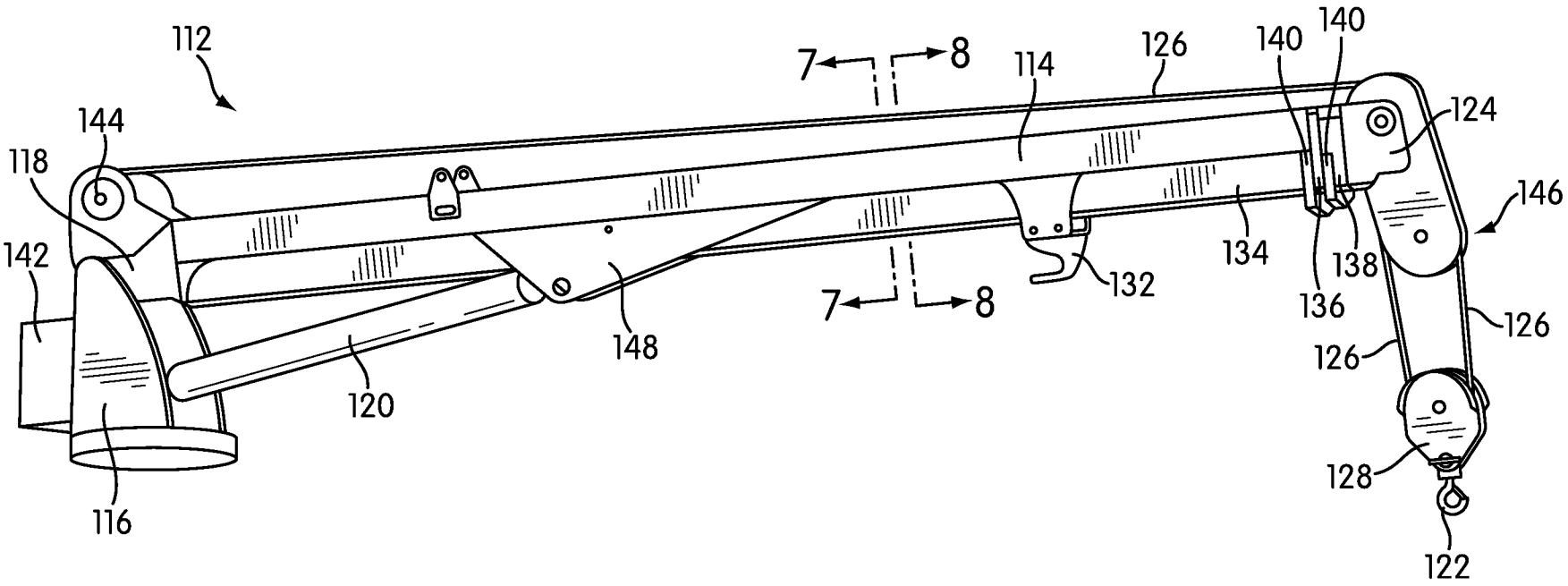
FIG. 3 is a perspective view of the telescoping crane of FIG. 1.

Referring to FIG. 3, the crane assembly 112 includes the boom 114 coupled to the mast 116 about the pivot 118. The boom 114 also includes stiffening plates 140 (e.g., stiffening collars) to reinforce the boom 114 along portions of the boom 114 that may receive increased stresses, such as ends of the sections 134, 136, 138. First- and second-stage extensions 136, 138 of the boom 114 are retracted in FIG. 3 in the storage configuration, where the second-stage extension 138 is telescopically nested within the first-stage extension 136 and the first-stage extension 136 is telescopically nested in the main section 134 of the boom 114. The projection 132 extends from the underside of the boom 114 for storage of the hook 122 and block 128.

According to an exemplary embodiment, a valve bank 142 is fastened to the mast 116 and coupled to the actuator 120 that raises and lowers the boom 114. In some embodiments, the valve bank 142 controls a flow of hydraulic fluid to and from the actuator 120, and to and from other hydraulic actuators of the crane assembly 112, such as those that may be used to rotate the boom 114 and extend the first- and second-stage extensions 136, 138. In contemplated embodiments, electric actuators or a power take-off from an engine may be used with or in place of hydraulic actuators for directly or indirectly moving the hook 122.

According to an exemplary embodiment, the cable 126 of the crane assembly 112 is at least partially wound on the spool of a hoist 144, which may be driven by a hydraulic motor. The cable 126 then extends along the top of the main section 134 of the boom 114 to the end 124 of the boom 114 opposite to the mast 116. In other contemplated embodiments, one or more cables extend through sections of the boom 114 or along a side of the boom 114 other than the top, or the hoist 144 is mounted to the end 124 of the boom 114 opposite to the mast 116.

In some embodiments, the end 124 of the boom 114, shown as the external end of the second-stage extension 138 (e.g., "horse head") in FIG. 3, includes sheaves about which the cable 126 extends. The cable 126 then extends to the block 128. According to an exemplary embodiment, the boom 114 includes an anti-two block system 146. The anti-two block system 146 is configured to stop the hoist 144 from winding the cable 126 too far such that the block 128 is pulled into the end 124 of the boom 114. Instead, a mechanical switch (not shown) stops the hoist 144, when the anti-two block system is activated. Contact of the block 128 with the switch on the end 124 of the boom 114 activates the system 146. Once activated, a controller (e.g., computerized controller) of the crane assembly 112 only allows for retracting of the extensions 136, 138 or 'winching down' (i.e., lowering) of the block 128 to release the block 128 from the end 124 of the boom 114.

Figure 4:
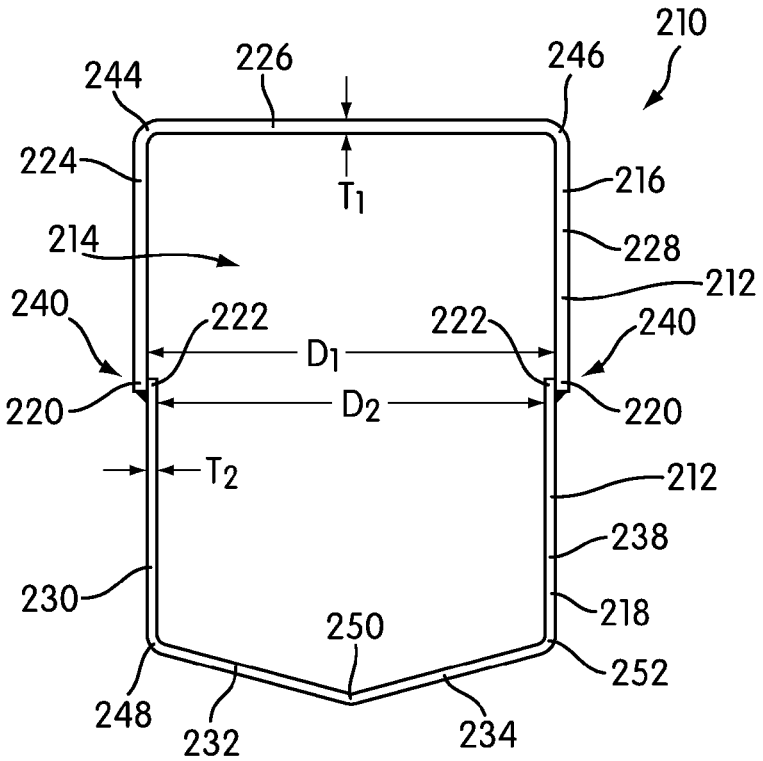
FIG. 4 is an end view of a section of a boom according to an exemplary embodiment of the invention.
Figure 5:
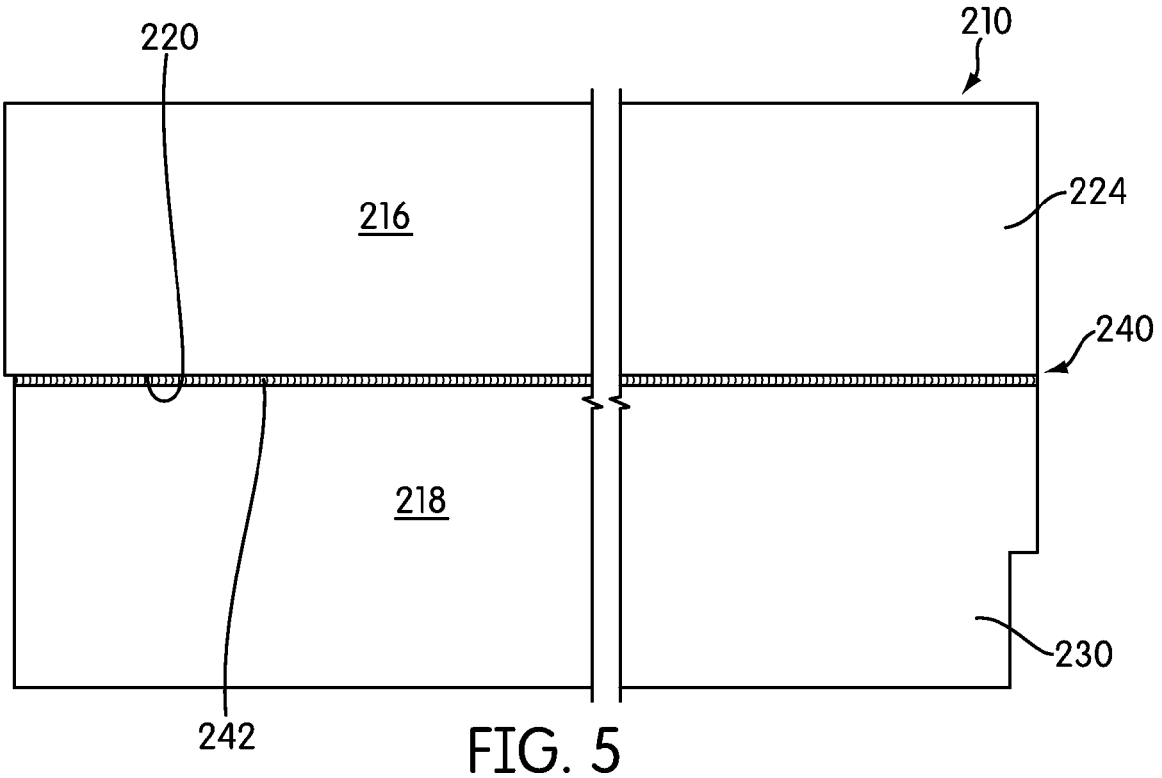
FIG. 5 is a side view of the section of the boom shown in FIG. 4.

Referring to FIGS. 4-5, a section 210 of a boom (see, e.g., boom 114 of the crane assembly 112 as shown in FIGS. 1-2) is elongate (FIG. 5) and includes a generally closed interior 214 and tubular cross-section 212 (FIG. 4). The section 210 is primarily formed from an upper piece 216 and a lower piece 218. The upper and lower pieces 216, 218 extend longitudinally along the section 210, with the upper piece 216 primarily forming the top of the section 210 and the lower piece 218 primarily forming the bottom or underside of the section 210, in some embodiments. The section 210 may further include other pieces, such as stiffening plates (see, e.g., stiffening plates 140 as shown in FIG. 3) and wear pads internal to the section 210 to facilitate sliding of telescoping embodiments.

According to an exemplary embodiment, the cross-section of the upper piece 216 (FIG. 4) is generally U- or saddle-shaped, having two open edges 220 extending lengthwise along the upper piece 216. Sides of the U- or saddle-shaped cross-section may be straight, not arcuate. According to such an embodiment, the cross-section of the lower piece 218 is also generally U- or saddle-shaped, and includes two open edges 222 extending lengthwise along the lower piece 218. The cross-section of the lower piece 218 may be different than that of the upper piece 216. In at least one embodiment, the cross-section of the upper piece 216 includes three flat sides 224, 226, 228, two sides 224, 228 substantially orthogonal to the third side 226. While the cross-section of the lower piece 218 includes four flat sides 230, 232, 234, 236, two substantially parallel sides 230, 236 and two sides 232, 234 forming a wedge or V-shape between the substantially parallel sides 230, 236.

According to an exemplary embodiment, the open edges 220 of the upper piece 216 are separated from one another by a first distance $D_1$, and the open edges 222 of the lower piece 218 are separated from one another by a second distance $D_2$. The difference between the first and second distances $D_1$, $D_2$ is approximately twice the thickness $T_1$, $T_2$, of at least one of the upper and lower pieces 216, 218. As such, during assembly of the section 210, the upper and lower pieces 216, 218 are configured to be joined together via a lap joint 240 with one another, where the open edges of one of the pieces overlap the open edges of the other piece. In some embodiments, the open edges 220 of the upper piece 216 are wider, and overlap the open edges 222 of the lower piece 218, while in other contemplated embodiments, vice versa.

According to an exemplary embodiment, once aligned with one another via the lap joint 240, the upper and lower pieces 216, 218 are welded together along the outside of the lap joint 240. The weld may have a continuous weld line 242 (e.g., bead), or may be formed from a combination of separated weld lines along the outside of the lap joint. In contemplated embodiments, additional welds are provided internal to the lap joint 240. In other contemplated embodiments, the upper and lower pieces 216, 218 are fastened together with fasteners (e.g., epoxy, rivets), without welding or in addition to welding.

Welding the upper and lower pieces 216, 218 together on the outside of the lap joint 240 is intended to provide an advantage for manufacturing the section 210 of the boom. A seal formed by overlapping the upper and lower pieces 216, 218 via the lap joint 240 serves to prevent molten welding material from passing through the lap joint 240 to the interior 214 of the tubular cross-section 212, which may otherwise form deposits of slag extending from the weld on the interior 214 of the section 210 of the boom. Without use of the lap joint 240 for welding the upper and lower pieces 216, 218, the an additional manufacturing step of "flash control" may then be required to remove slag from the interior of a corresponding section, to allow for smooth telescoping of nested embodiments of such sections. In alternative embodiments, upper and lower pieces of the boom are fastened together without a lap joint, and flash control is performed.

In some embodiments, the upper and lower pieces 216, 218 are welded together along the sides 224/230, 228/238 of the substantially pentagonal cross-section 212 through which the neutral axis of the boom extends. Because the neutral axis of the boom receives the least tensile and compressive loading within the boom, the sides 224/230, 228/238 of the section 210 containing the neutral axis are believed to have less tensile and compressive loading than the other sides 226, 232, 234 of the section 210. In some such embodiments, the weld line 242 between the upper and lower pieces 216, 218 is substantially aligned with and/or proximate to the neutral axis (e.g., within three inches) to reduce loading on the weld line 242.

In some embodiments the cross-section 212 of the section 210 is substantially pentagonal, where the cross-section 212 includes primarily five flat sides 226, 232, 234, 224/230, 228/238. In some embodiments, two of the sides 224/230, 228/238 are formed from overlapping pieces 216, 218, and are not strictly flat or contiguous. Also, the vertices of the substantially pentagonal cross-section 212 are not points, but instead are formed as rounded corners 244, 246, 248, 250, 252. Rounding the corners 244, 246, 248, 250, 252 is intended to reduce stress concentrations and is believed to be more easily manufactured than sharp corners. In alternative embodiments the cross-section is rectangular, hexagonal, a complex geometry, or otherwise shaped. In other alternative embodiments, the cross-section is not closed, but is instead C-shaped, or the boom is formed from a truss.

Figure 17:
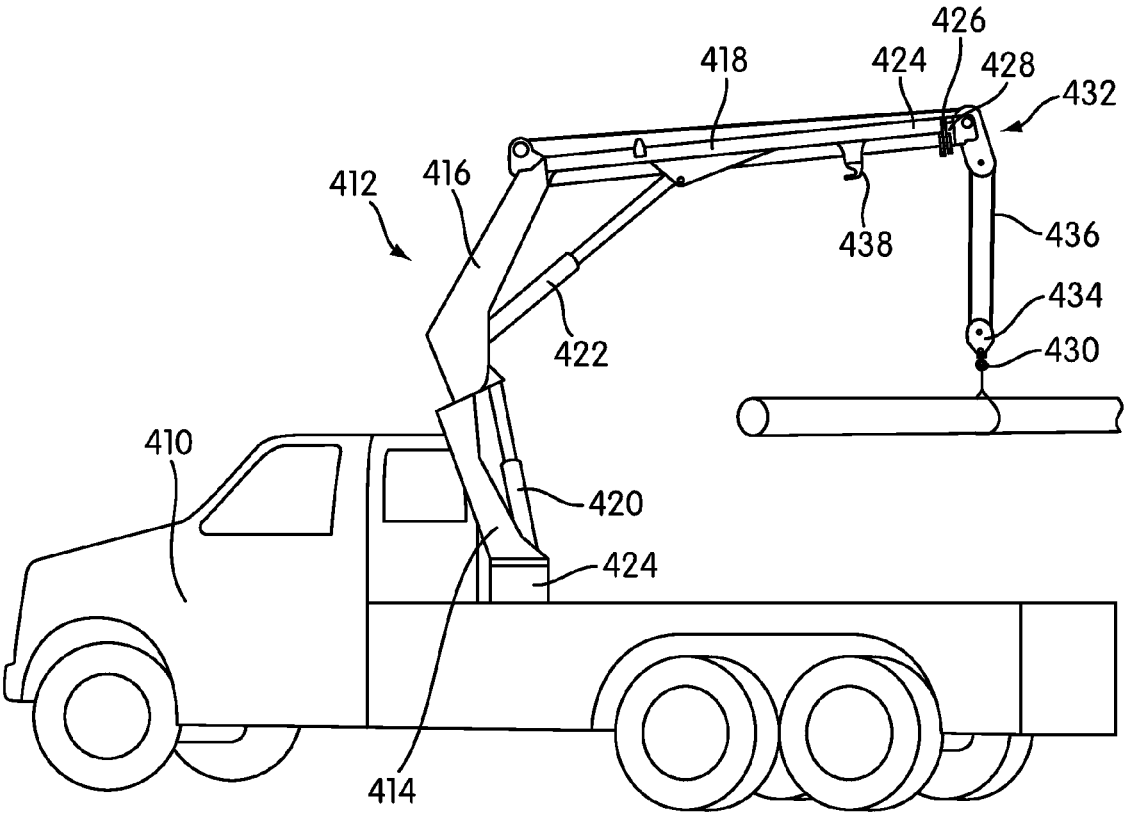
FIG. 17 is a perspective view of an articulated crane mounted on a vehicle according to an exemplary embodiment of the invention.

According to an exemplary embodiment, the upper and lower pieces 216, 218 have different thicknesses $T_1$, $T_2$ than one another. The thicknesses $T_1$, $T_2$ of the upper and lower pieces 216, 218 are selected based upon an intended application of the boom. For example, if the boom is designed for use as a segment of an articulated crane (see, e.g., articulated crane 412 as shown in FIG. 17) requiring a relatively high load capacity, then the thickness of the upper piece may be increased relative to the thickness of an upper piece of a similarly-sized section of boom intended for use with a telescoping crane having a relatively light load capacity. However, thicknesses of the lower pieces may be identical for both booms. Accordingly use of separate upper and lower pieces 216, 218 allows for great modularity and customization of the crane assembly in some embodiments. Upper and lower pieces 216, 218 of different dimensions or materials can be mixed and matched, as necessary, to build a section intended to perform efficiently in a given application. In contemplated embodiments, one or both of the upper and lower pieces do not have uniform thicknesses.

According to an exemplary embodiment, the upper piece 216 is thicker than the lower piece 218. The upper piece 216, in some such embodiments, forms a substantially square U-shape, and is believed to receive much of the pivot load resisting the cantilever loading of the boom during operation of the boom in some applications. Accordingly, thicker material is used on the portion of the boom that receives greater loading, and thinner material is used on the portion of the boom that receives lesser loading, conserving materials on the portion receiving lesser loading and providing for a lighter overall boom. The lighter boom increases the efficiency of the crane assembly because a greater proportion of the energy used for lifting and moving the boom is dedicated to lifting and moving cargo, construction materials, or other items moved by the crane, instead of lifting and moving the boom itself.

One of the benefits of designs disclosed herein, is that use of folded metal sheets to form upper and lower pieces of sections of a boom allows for a continuous range dimensional choices for the sections. The design is not limited to set dimensions associated with pre-formed tubes. By way of example, in one particular embodiment the upper and lower pieces 216, 218 are each formed via a press brake or stamped from sheets of steel, each having surfaces of roughly two by ten feet. In this particular example, the upper piece 216 is about a quarter inch thick and the lower piece 218 is about three-sixteenths of an inch thick. The sheets are folded and robotically welded together along a lap joint 240 to form a section 210 of the boom having a pentagonal cross-section, where the inner radii of the upper corners 244, 246 are about a quarter-inch and the inner radii of the lower corners 248, 252 are about three-sixteenths of an inch. In this particular example, the sheets are folded so that the top side 226 of the section 210 is about eight inches wide. The inside angle between one of the substantially parallel sides 230, 238 and the next closest side 232, 234 of the lower piece 218 is about 105-degrees. In this one particular example, a three-sixteenths inch fillet weld is used on the outside of the lap joint 240, and the upper and lower pieces 216, 218 overlap one another by about a quarter of an inch. Some or all of the dimensions of the example may be used with other embodiments or configurations described herein. However, the apparatus of the present invention is not limited to particular dimensions, sizes, shapes, or ratios, unless expressly recited in the claims.

In alternative embodiments, the upper and lower pieces have the same distance between open edges, and are fastened together misaligned with one another such that the inside edge of the upper piece overlaps the outside edge of the lower piece on one side of the section and the inside edge of the lower piece overlaps the outside edge of the upper piece on the other side of the section. In contemplated embodiments, the pieces are joined together side-by-side to one another, where neither piece is upper or lower relative to the other, but instead the pieces are joined as two sides of a section of a boom. In other contemplated embodiments, a lap joint is not used to join the pieces, but the pieces are instead welded together on open edges of the two pieces.

Figure 6:
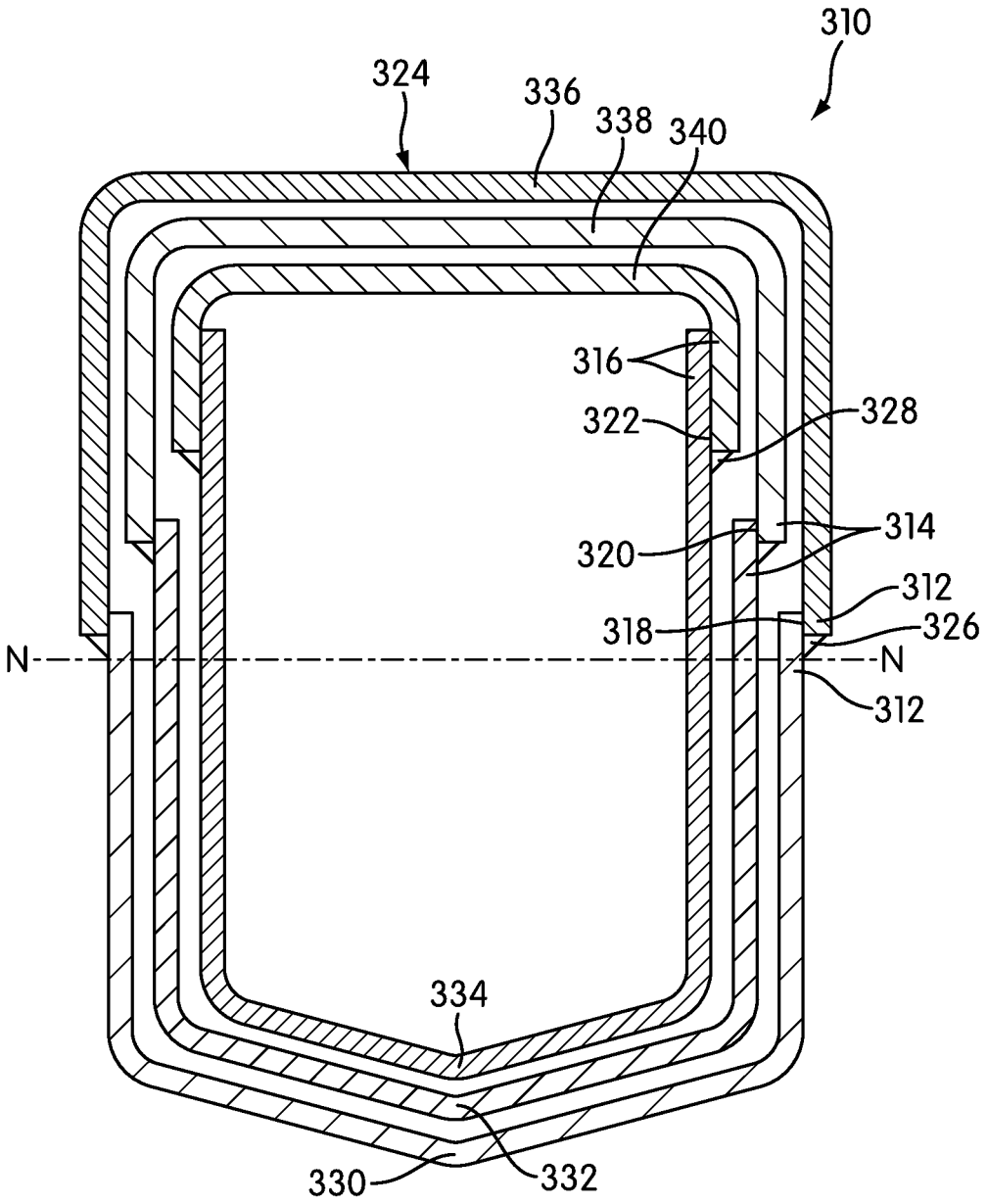
FIG. 6 is an end view of nested sections of a boom according to an exemplary embodiment of the invention.

Referring now to FIG. 6, a telescoping boom 310 of a crane assembly includes first, second, and third sections 312, 314, 316. The third section 316 is nested within the second section 314, which is nested within the first section 312. Furthermore, the third section 316 is configured to slide relative to the second section 314, and the second section 314 is configured to slide relative to the first section 312. The sections 312, 314 may include composite nylon wear pads (not shown) positioned on inside surfaces of the sections 312, 314 to facilitate the sliding.

According to an exemplary embodiment, each section 312, 314, 316 is formed from two pieces fastened together along lap joints 318, 320, 322 between the respective two pieces. In some such embodiments, each of the sections 312, 314, 316 has a cross-section that is tubular and substantially pentagonal. According to an exemplary embodiment, the lap joint 320 of the second section 314 is closer to a top side 324 of the boom 310 than the lap joint 318 of the first section 312, and the lap joint 322 of the third section 316 is closer to a top side 324 of the boom 310 than the lap joint 320 of the second section 314. Staggering the lap joint 318, 320, 322 allows for a compact, nested arrangement of the sections 312, 314, 316. Additionally, staggering the lap joints 318, 320, 322 in the particular arrangement shown in FIG. 6, with the lap joints 318, 320, 322 being located further from the neutral axis with each successively narrower section 312, 314, 316, allows the section 312 that experiences the greatest load during operation of the boom 310, the first section 312, to have a weld line 326 closest to the neutral axis, and the section that experiences the least load, the third section 316, to have a weld line 328 furthest from the neutral axis.

Still referring to FIG. 6, vertices 330, 332, 334 (e.g., peaks) of the pentagonal cross-sections of each of the sections 312, 314, 316 extend along the lengthwise, bottom centerline of each respective section 312, 314, 316. Accordingly, the vertices 330, 332, 334 are generally aligned with the centers of gravity of the sections 312, 314, 316. Use of a substantially pentagonal cross-section for sections 312, 314, 316 of the boom 310, with the vertices 330, 332, 334 of the substantially pentagonal cross-section pointing downward, is intended to provide a self-aligning or self-tracking feature to telescoping embodiments of the sections 312, 314, 316 of the boom 310. The vertices 330, 332, 334 of the nested sections 312, 314, 316 align with one another when the sections 312, 314, 316 move relative to each other, as the boom 310 is raised or lowered. The vertices 330, 332, 334 of the substantially pentagonal cross-sections for the sections 312, 314, 316 provide the self-aligning benefits, while the sections 312, 314, 316 also receive the transverse strength benefits provided by the square top portions 336, 338, 340 of the sections 312, 314, 316 for withstanding side loads.

Figure 7:
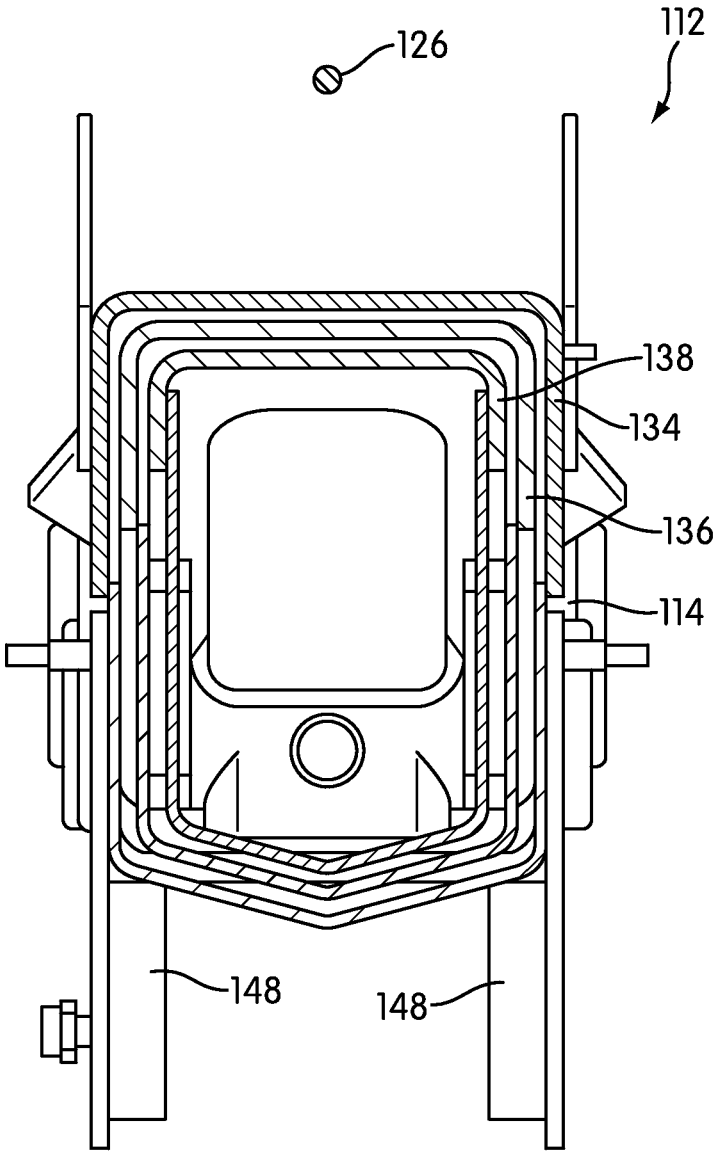
FIG. 7 is a sectional view of the telescoping crane of FIG. 3, taken along line 7-7 of FIG. 3.
Figure 8:
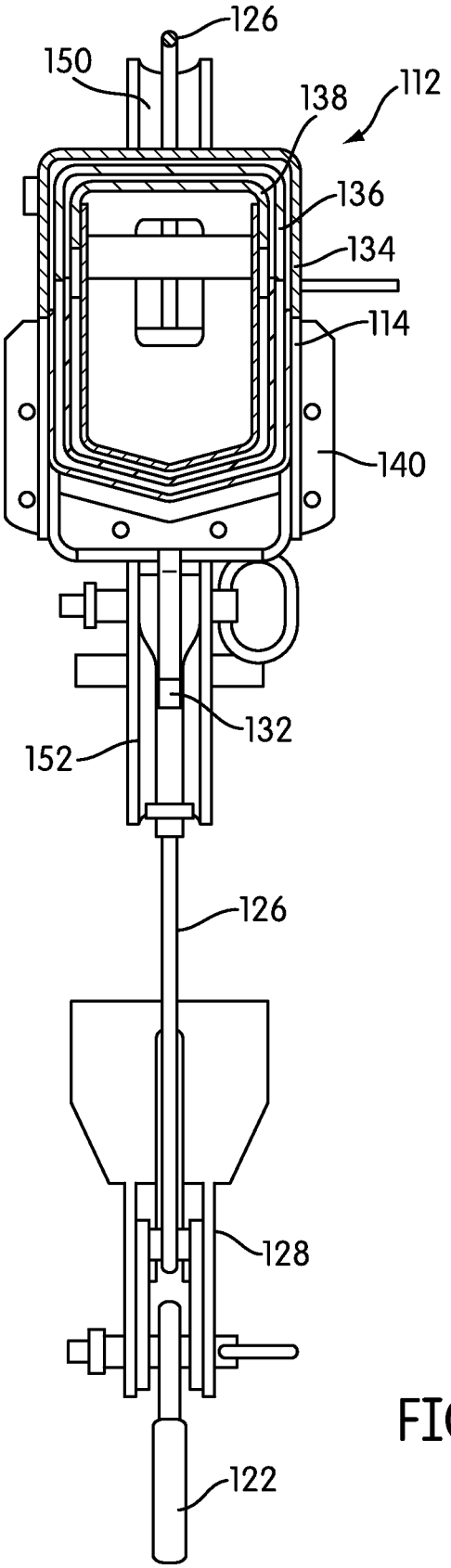
FIG. 8 is a sectional view of the telescoping crane of FIG. 3, taken along line 8-8 of FIG. 3.

Referring now to FIGS. 7-8, the boom 114 of FIGS. 1-3 includes a nested arrangement of the main section 134, first-stage extension 136, and second-stage extension 138. Each of the sections 134, 136, 138 are formed from upper and lower pieces, similar to the sections 312, 314, 316 of FIG. 6, where the upper pieces are fastened to the lower pieces via lap joints. Brackets 148 for fastening the actuator 120 (FIG. 3) to the underside of the boom 114 are shown extending from the main section 134 in FIG. 7. The cable 126 extends around a first sheave 150 and a second sheave 152 on the end 124 (FIG. 3) of the boom 114, and a stiffening plate 140 (e.g., cap plate) is configured to support wear pads as shown in FIG. 8.

Referring to FIG. 8, the hook 122 hangs below the end 124 of the boom 114 in an operational configuration, configured to attach items for lifting and moving. According to an exemplary embodiment, the hook 122 is fastened to the block 128, which is coupled to the end 124 of the boom 114 via the cable 126. The cable 126 is wrapped around a third sheave 154 integrated with the block 128. Although shown as hanging from the end 124 of the boom 114 in FIG. 8, the hook 122 and block 128 are also configured to be supported by the projection 132 when the crane assembly 112 is in the storage configuration, as shown in FIG. 9.

Figure 9:
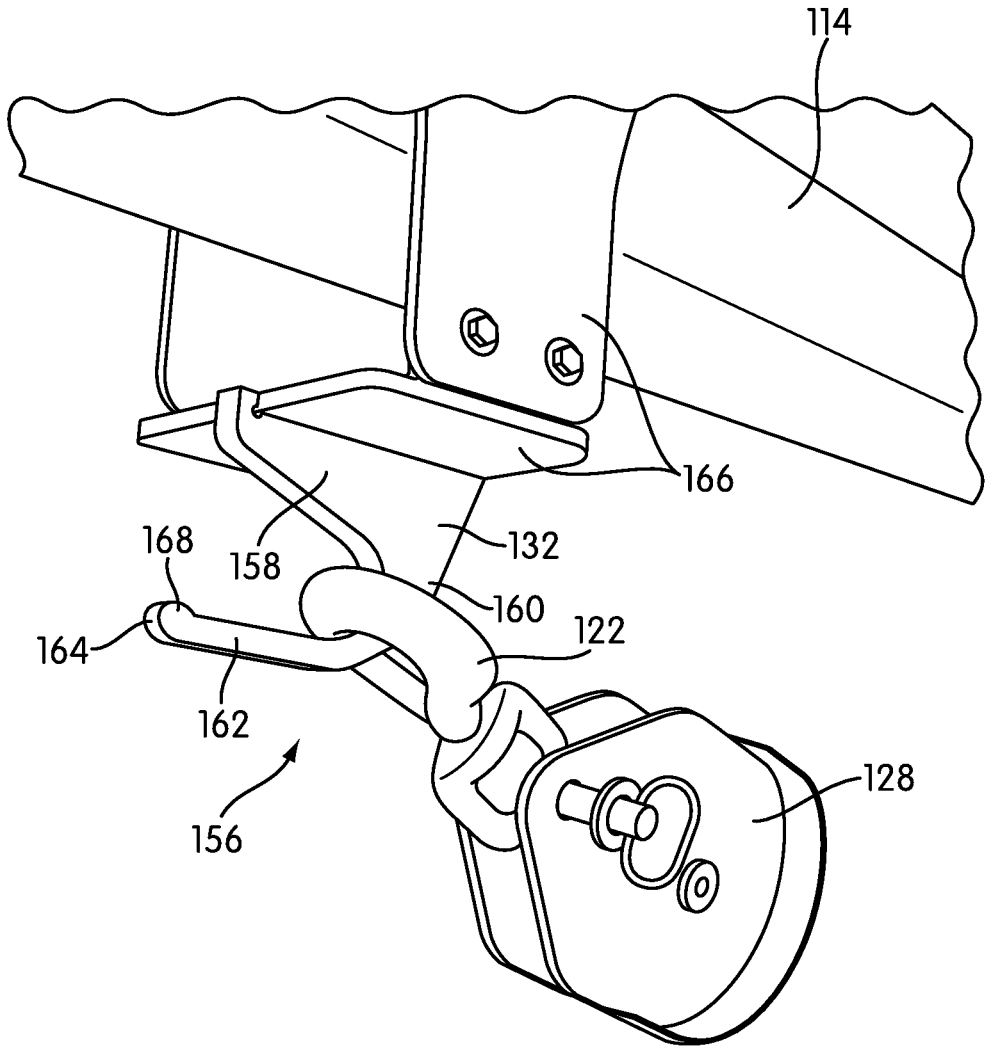
FIG. 9 is a perspective view of a hook stored on a boom according to an exemplary embodiment of the invention.
Figure 10:
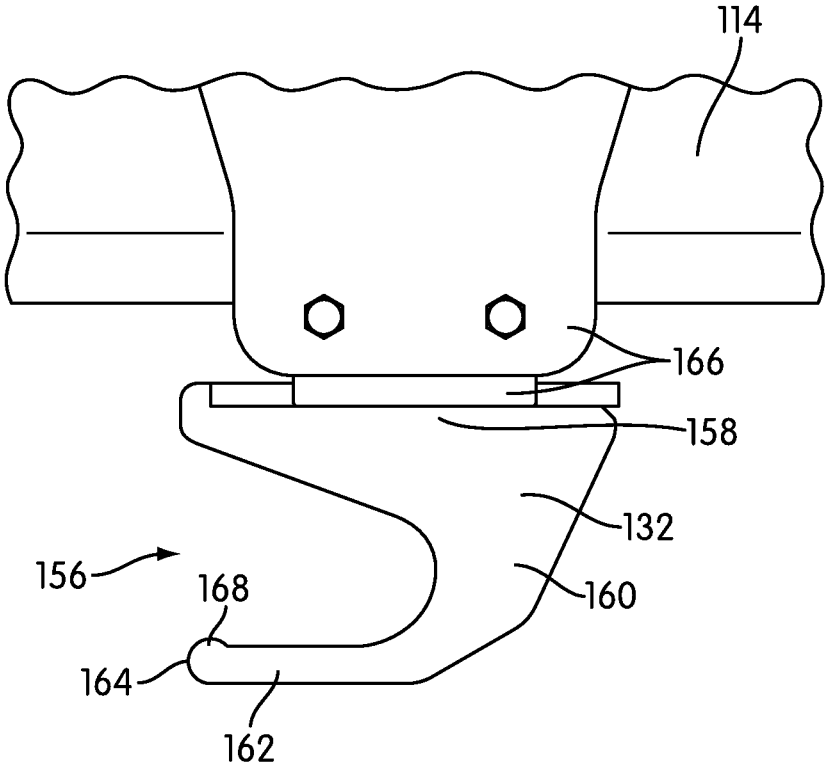
FIG. 10 is a side view of the hook and boom of FIG. 9.

Referring to FIGS. 9-10, the projection 132 (e.g., extension, storage hook) is part of an automatic-release hook stow system 156 for the crane assembly 112 (FIG. 3). According to an exemplary embodiment, a first portion 158 of the projection 132 extends outward from the boom 114. A second portion 160 of the projection 132 extends from the first portion 158 and curves toward the main body of the crane assembly 112 or toward the end of the boom 114 that connects to the mast 116 (FIG. 3). A third portion 162 of the projection 132 extends from the second portion 160 and generally projects tangentially from the second portion 160 toward the main body of the crane assembly 112 or toward the end of the boom 114 that connects to the mast 116.

According to an exemplary embodiment, the third portion 162 of the projection 132 is substantially straight, while in other contemplated embodiments the third portion is arcuate, and may extend seamlessly from the second portion 160 of the projection 132. In some embodiments, the third portion 162 of the projection 132 is substantially parallel with the longitudinal axis of the boom 114. In other contemplated embodiments, the third portion is angled upward or downward relative to the longitudinal axis of the boom, but is still generally directed toward the main body of the crane assembly 112 or toward the end of the boom 114 that connects to the mast 116.

Still referring to FIGS. 9-10, the projection 132 includes an open end 164, where the projection 132 is configured to receive the loop of the hook 122 over the end 164 of the projection 132. The cable 126 may then be wound by the hoist 144 (FIG. 3) such that tension in the cable 126 holds the hook 122 to the projection 132 for stowing the hook 122. Alternatively, the end 124 (FIG. 3) of the boom 114 may be moved outward from the main extension 134 (FIG. 3) to increase tension in the cable 126 to hold the hook 122 to the projection 132. According to an exemplary embodiment, when the boom 114 is raised and tension in the cable 126 is released, gravity is sufficient to release the hook 122 from the projection 132. The hook 122 slides off of the projection 132 from the open end 164.

Accordingly the automatic-release hook stow system 156 provides a convenient and automatic way to release the hook 122 from being stowed on the projection 132 for operational use of the crane assembly 112. By contrast, if a loop or eyelet (not shown) attached to the boom were used in place of the projection, an operator of the associated crane assembly may have to lower the boom, manually release the hook from the loop, and then raise the boom before the crane assembly is ready for operation. As such, the projection 132 of the automatic-release hook stow system 156 significantly increases the efficiency of storing and releasing the hook 122 from the storage configuration. However, in other embodiments a loop or eyelet may be fastened to the boom 114 of the crane assembly 112 for stowing the hook 122, in place of the projection 132.

According to an exemplary embodiment, the first, second, and third portions 158, 160, 162 of the projection 132 are integrally formed with one another via a mold or are cut from a sheet. However, in other contemplated embodiments, the portions 158, 160, 162 are at least partially formed from separate components that are subsequently fastened together. In some embodiments, the projection 132 is fastened (e.g., welded) to a bracket 166 that is bolted, clamped, welded or otherwise coupled to the boom 114. In other embodiments, the projection 132 is directly fastened to the boom 114.

According to an exemplary embodiment, the boom 114 is telescoping and includes the main section 134 (FIG. 2), the first-stage extension 136 (FIG. 2) configured to slide from within the main section 134, and the second-stage extension 138 (FIG. 2) configured to slide from within the first-stage extension 136. In some such embodiments, the projection 132 extends from the main section 134 of the boom 114. According to an exemplary embodiment, the projection 132 extends downward from an underside of the boom 114 and curves rearward toward the main body of the crane assembly 112 or toward the end of the boom 114 that connects to the mast 116. In other contemplated embodiments, the projection 132 extends outward from a side of the boom 114 and then curves generally toward the main body of the crane assembly 112 or toward the end of the boom 114 that connects to the mast 116, such that tension in the cable 126 secures the hook 122 to the projection 132 when in the storage configuration.

According to an exemplary embodiment, the end 164 of the projection 132 includes a lip 168. In some embodiments, the lip 168 is bulbous or rounded, while in other contemplated embodiments the lip is square, triangular, or otherwise contoured. The lip 168 extends from the end 164 of the projection 132, in a direction generally toward the boom 114 and orthogonal to the length of the third portion 162. In some embodiments, the lip 132 serves to keep the hook 122 coupled to the projection 132 when the boom 114 is not fully raised or when tension in the cable 126 is not sufficient to hold the hook 122 to the projection 132. In other embodiments, the projection does not include a lip.

In contemplated embodiments, a hook storage system includes a loop with a moving element (e.g., gate, latch). In a first configuration, such as when the boom is lowered and stored, the hook storage system forms a closed loop. In a second configuration, such as when the boom is raised, the moving element of the hook storage system allows the hook to slide through a temporarily open portion of the loop. As such, in the second configuration, the hook storage system forms a projection, which may be similar to the projection 132 of FIG. 10, with an open area through which the hook may be released. In such contemplated embodiments, the moving element may be actuated by gravity or via an actuator, such as a solenoid, hydraulic cylinder, stepper motor, mechanical linkage (e.g., Bowden cable and trigger) or another actuator. The actuator may be manually controlled, or automatically controlled, such as by a computerized controller when the boom is sufficiently raised and extended.

In contemplated embodiments, the projection includes a mechanical switch to stop the hoist from pulling the block beyond the necessary amount to secure the hook. In some such embodiments, the projection is biased about a pivot or flexible portion coupled to the mechanical switch. If the hook is pulled too tightly, the pivot or flexible portion engages the mechanical switch. In some such embodiments, the mechanical switch of the projection may be electrically or mechanically coupled to the anti-two block system, or may be a separate system.

Figure 11:
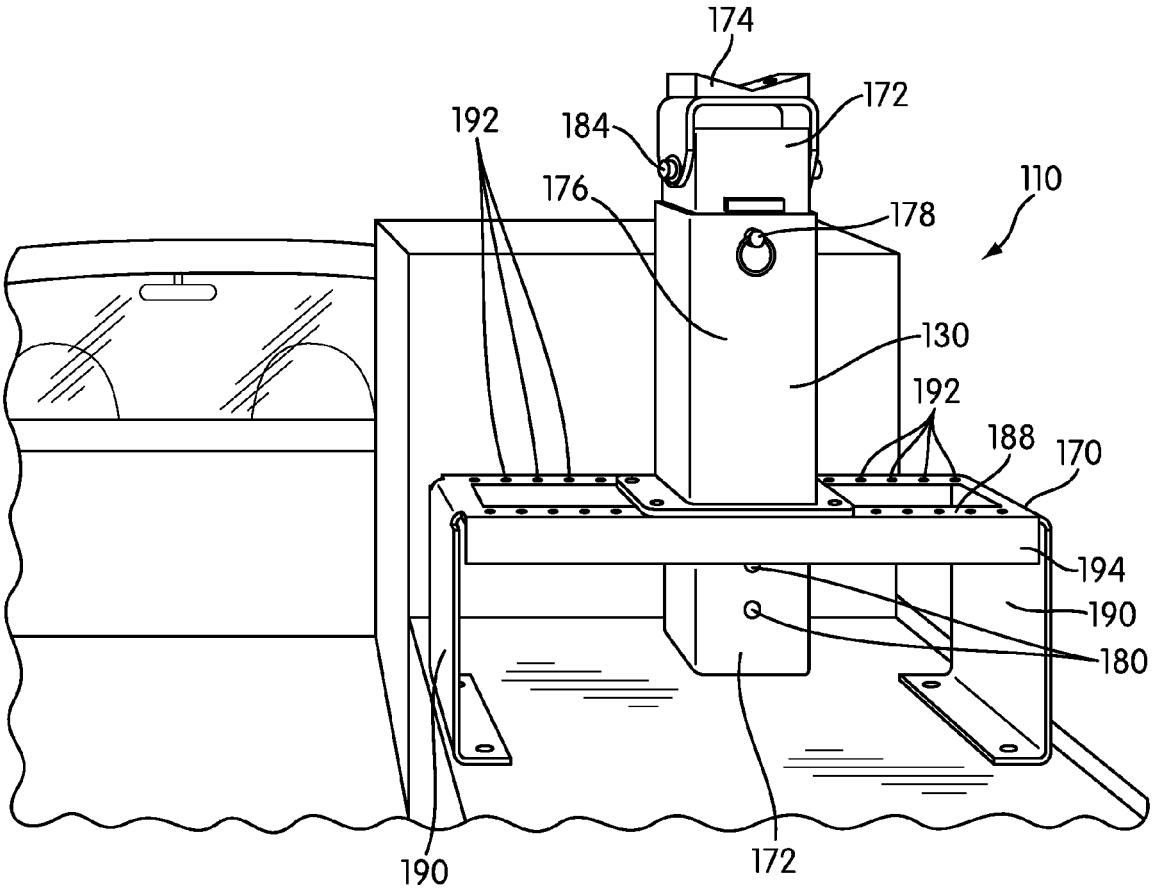
FIG. 11 is a perspective view of a rest for storing a boom according to an exemplary embodiment of the invention.
Figure 12:
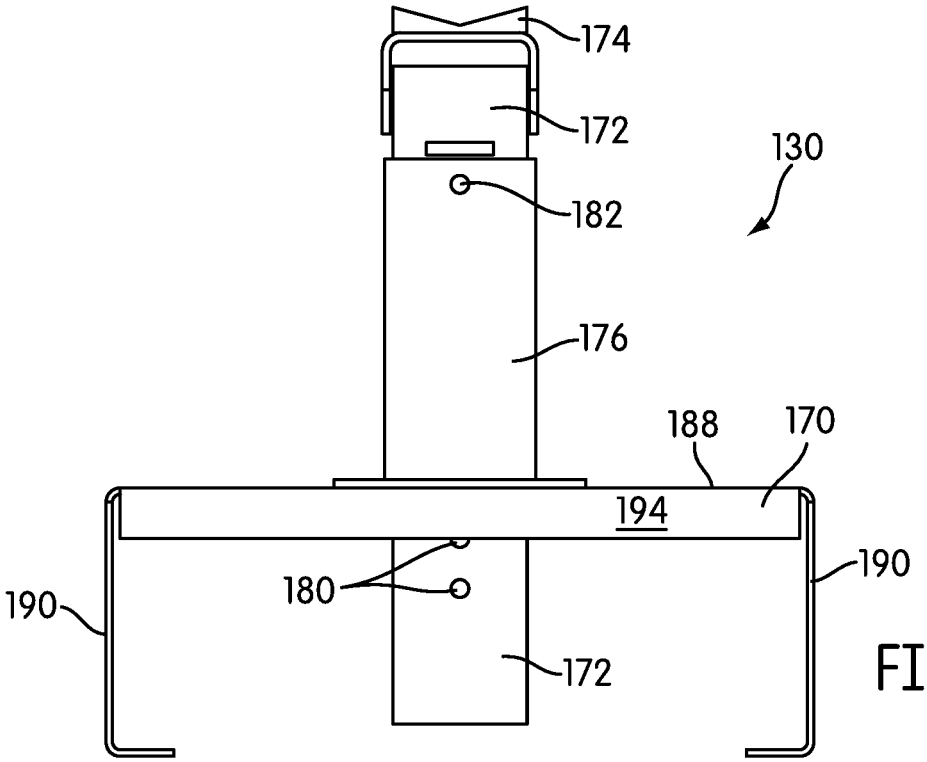
FIG. 12 is a front view of the rest of FIG. 11.
Figure 13:
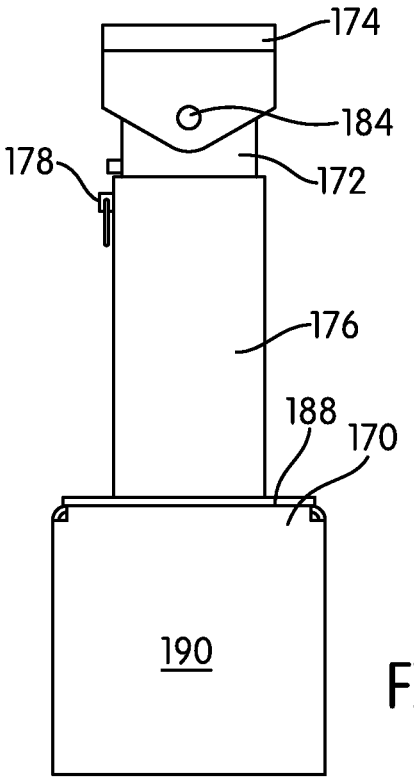
FIG. 13 is a side view of the rest of FIG. 11.
Figure 14:
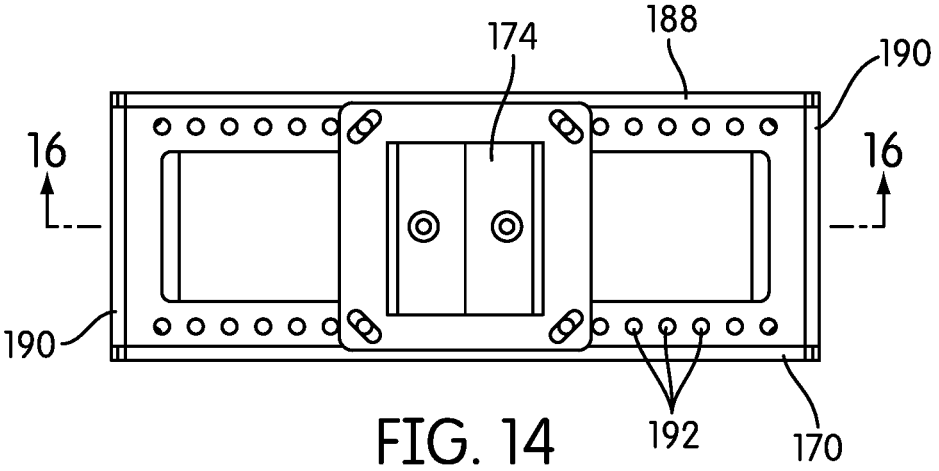
FIG. 14 is a top view of the rest of FIG. 11.
Figure 15:
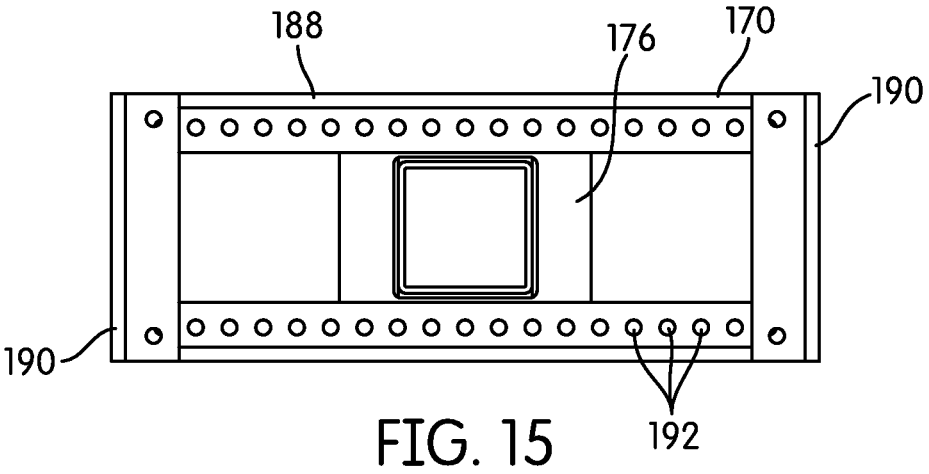
FIG. 15 is a bottom view of the rest of FIG. 11.
Figure 16:
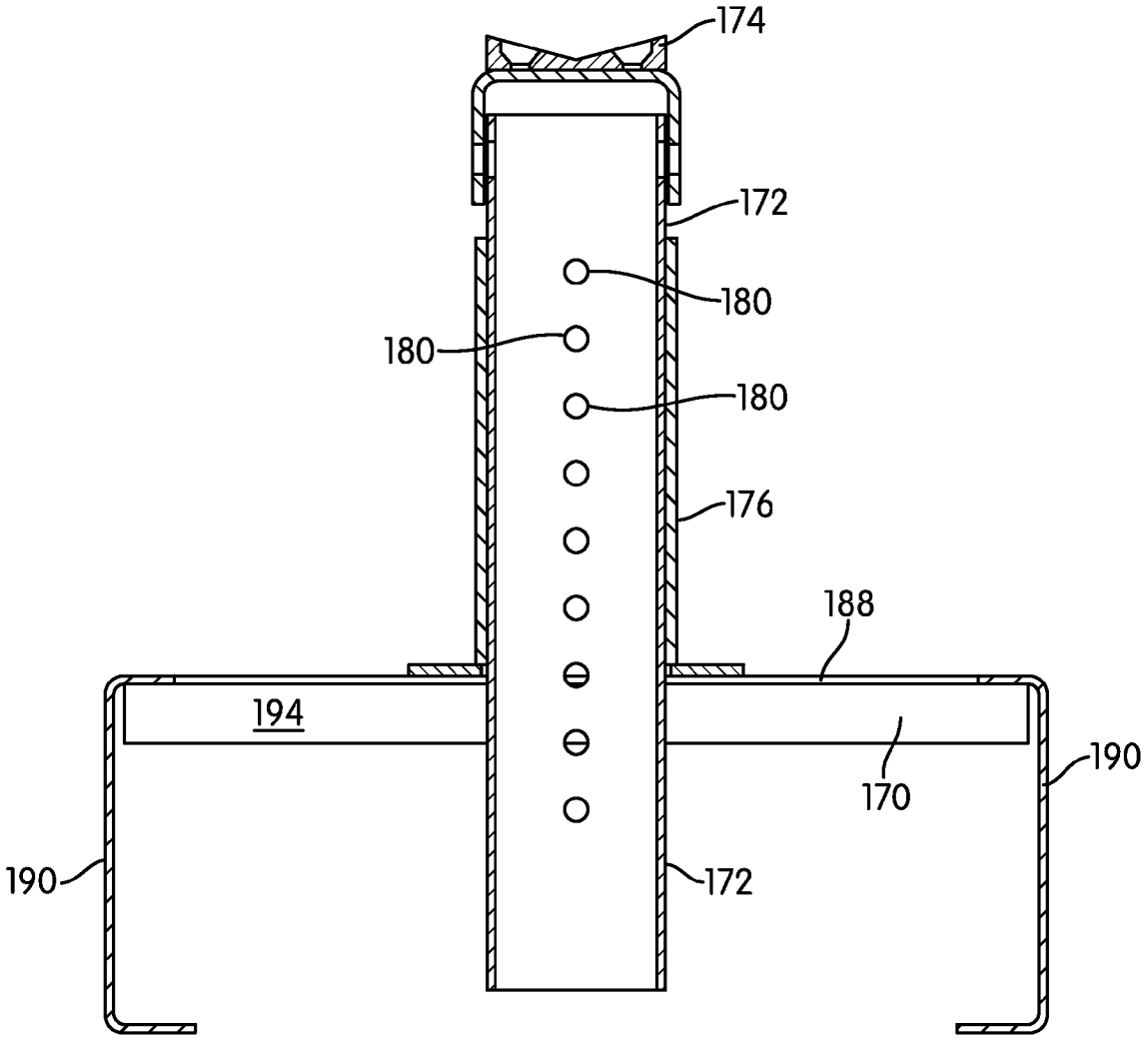
FIG. 16 is a sectional view of the rest of FIG. 11, taken along line 16-16 of FIG. 14.

Referring now to FIG. 11, the crane assembly 112 includes the rest 130 for receiving the boom 114 of the crane assembly 112 when the crane assembly 112 is positioned in the storage configuration (see crane assembly 112 and rest 130 as shown in FIGS. 1-2). Applicants have observed that some crane operators may inadvertently lower booms too far when storing the booms on support structures of corresponding crane assemblies, damaging the support structures and crane assemblies. Lowering of a boom past the top of the support structures may crush or permanently deform the support structures, the boom, and underlying portions of the crane. Accordingly in some embodiments disclosed herein, the rest 130 is configured to absorb downward force of the boom 114, whereby damage to the main body of the crane assembly 112 and boom 114 is mitigated by the rest 130.

According to an exemplary embodiment, one or more components of the rest 130 are designed to elastically or plastically deform to absorb downward force of the boom 114. In some embodiments, at least a portion of the rest 130 is particularly configured to plastically deform or give way before sufficient force is transferred through the rest 130 to plastically deform or crack the boom 114 or the portion of the main body of the crane assembly 112 to which the rest 130 is coupled. Deformation of the rest 130 may be serve to alert the operator that the boom 114 has been moved beyond the intended orientation of the boom 114 for storage.

Referring now to FIGS. 11-16, the rest 130 includes a base 170, a column 172 coupled to the base 170, and a seat 174 coupled to an end of the column 172 configured to receive the boom 114. In some embodiments, the rest 130 further includes a sleeve 176 attached to the base 170, and the column 172 is coupled to the base 170 by way of the sleeve 176. According to an exemplary embodiment, the column 172 is telescopingly coupled to the sleeve 176, where a pin 178 and overlapping apertures 180, 182 (FIGS. 12 and 16) of the column 172 and sleeve 176 allow for raising and lowering of the column 172 and seat 174 relative to the base 170, allowing for different heights of the rest 130. In other embodiments, the column 172 is directly and rigidly fastened to the base 170. According to an exemplary embodiment, the seat 174 is pivotally fastened to the top of the column 172 by a pin 184. As such, the orientation of the seat 174 conforms to the angle of the boom 114 as the boom 114 is lowered into contact with the seat 174. In other embodiments, the seat 174 is fixed to the end of the column 176.

According to an exemplary embodiment, the base 170 is configured to absorb force from the boom 114 by deforming when loaded vertically downward. In some embodiments, the base 170 includes a horizontal portion 188 and two or more legs 190 extending from the horizontal portion 188 to the main body of the crane assembly 112. The sleeve 176 is fastened to the horizontal portion 188. In some embodiments, the horizontal portion 188 further includes bolt holes 192 allowing the sleeve 176 to be fastened to the horizontal portion 188 in several positions along the length of the horizontal portion 188. A flange 194 extending from the horizontal portion 188 provides rigidity to the horizontal portion 188.

According to an exemplary embodiment, the legs 190 of the base 170 of the rest 130 are configured to bow (e.g., flare) when the base 170 is loaded vertically downward. The legs 190 bow outward in some embodiments, and deform through an elastic range followed by plastic deformation as downward force of the boom increases. In some embodiments, the legs 190 are configured, via material selection and geometry, to plastically deform before sufficient force is transmitted through the legs 190 to plastically deform or crack (e.g., rupture, collapse) the boom 114 or the portion of the main body of the crane assembly 112 to which the rest 130 is coupled. In some embodiments, the horizontal surface 170 is configured to bow and fail, in a similar manner, in order to mitigate damage to the main body of the crane assembly 112.

According to an exemplary embodiment, the boom 114 includes an underside that is wedge-shaped, and the seat 174 of the rest 130 includes a wedge-shaped surface recess to receive the underside of the boom 114. In some such embodiments, the mating, wedge-shaped surfaces of the boom 114 and seat 174 provides self-aligning of the boom 114 , and helps the boom 114 to resist side loading (e.g., from wind, changes in momentum as the utility vehicle 110 turns, etc.) when the boom 114 is in the storage configuration. In other embodiments, the boom and seat are otherwise shaped, where the seat is inversely contoured to receive the underside of the boom.

In contemplated embodiments, the pin 178 between the column 172 and the sleeve 176 is configured, via material selection and geometry, to shear (e.g., fail) before sufficient downward force is applied to the rest 130 to plastically deform or crack at least one of the rest 130, the boom 114, and the portion of the main body to which the rest 130 is fastened. In other embodiments, a pin 184 between the seat 174 and column 172 is configured to shear before sufficient downward force is applied to the rest 130 to plastically deform or crack at least one of the rest 130, the boom 114, and the portion of the main body to which the rest is fastened. One or both of the pins 178, 184 may be used in conjunction with deformation of the legs 190 of the base 170 to mitigate damage to at least one of the rest 130, the boom 114, and the portion of the main body to which the rest 130 is fastened.

In contemplated embodiments, the column of a rest for a boom is configured to give way when force of the boom exceeds a threshold value, without plastically deforming or permanently breaking components of the rest 130. In one such embodiment, the sleeve and column are coupled via a spring-loaded latch. When force of the boom exceeds the threshold value, the latch opens and allows the column to slide downward within the sleeve. The operator is notified that the release has been triggered by the sudden movement of the column and boom, or by another for of alert. Once the boom is again raised, the column may be raised back up through the sleeve, and the spring-loaded latch may be re-engaged allowing the boom to again be lowered onto the rest.

In contemplated embodiments, the rest is coupled to the controller of the boom such that feedback from the rest is received by the controller to prevent the boom from being lowered to cause damage to the boom or main body of the crane. In at least one embodiment, the rest includes a pressure or load sensitive switch that instructs the boom controller to stop lowering the boom, or automatically stops the boom from further lowering in a manner similar to the way the anti-two block system 146 is used by the controller of the hoist to prevent the block from damaging the end of the crane. In some such embodiments, the switch is mechanically linked to deformation or energy absorption of the rest, such that when the rest absorbs a predetermined amount of loading, the switch is triggered and the controller automatically stops the boom. In other contemplated embodiments, load cells, pressure sensors, strain gauges, or other sensors are used to provide feedback to a control computer that is configured to lower the boom in a manner that mitigates damage to the crane assembly.

Referring to FIG. 17, an utility vehicle 410 includes an articulated crane assembly 412 (e.g., articulated arm) having a first segment 414, a second segment 416, and a third segment 418. The segments 414, 416, 418 are moved relative to one another by linear actuators, such as hydraulic cylinders 420, 422. A rotation system 424 coupled to the first segment 414 allows the first segment 414 to rotate relative to the chassis of the utility vehicle 410. The articulated crane assembly 412 may be configured to support transport and construction applications.

According to an exemplary embodiment, the third segment 418 of the articulated crane assembly 412 includes a telescoping boom that includes a main section 424, a first-stage extension 426, and a second-stage extension 428, where the first- and second-stage extensions 426, 428 are nested within the main section 424. A hook 430 or other tool is coupled to a distal end 432 of the third segment 418 by way of a block 434 and cable 436. According to an exemplary embodiment, the sections 424, 426, 428 of the third segment 418 are formed from upper and lower pieces, as disclosed with regard to FIGS. 4-6. According to another exemplary embodiment, the main section 424 of the third segment 418 includes a projection 438 for stowing the hook 430, as disclosed with regard to FIGS. 9-10.

Loading on the segments 414, 416, 418 of the articulated crane assembly 412 may differ from the loading of the boom 114 shown in FIGS. 1-2 because the articulated arrangement of the segments 414, 416, 418 allows the segments 414, 416, 418, particularly the second and third segments 416, 418, to be angled horizontally or even more than ninety degrees from vertical. As such, the sections of the segments 414, 416, 418, in some embodiments, greatly benefit from having substantially pentagonal cross-sections formed from upper and lower pieces having customized thicknesses that are designed to meet the particular loading requirements of the articulated crane assembly 412.

The construction and arrangements of the crane assembly, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A crane assembly, comprising:

a main body;

a boom extending from the main body and comprising a tubular main section and a tubular extension section telescopically nested within the tubular main section, the tubular main section having a top side, an opposing underside, and a sidewall separating the top side of the tubular main section from the opposing underside of the tubular main section, wherein the tubular main section has a first end pivotally coupled to the main body;

a hoist coupled to the first end of the boom;

a sheave disposed at an opposing second end of the boom opposite to the main body, wherein the first end and the opposing second end are separated by a length of the boom;

a cable extending from the hoist, along the length of the boom along the top side of the tubular main section, over the sheave, and downward to the opposing underside of the tubular main section;

a hook coupled to the opposing second end of the boom by the cable, wherein the crane assembly is configured for lifting items via the hook; and a projection extending outward from the boom and curving toward the main body, wherein the projection is configured to receive the hook over an end of the projection such that tension in the cable maintains the hook in place on the projection, and wherein gravity is sufficient to release the hook from the projection when the boom is raised and the tension in the cable is released.

2. The crane assembly of claim 1, wherein the projection extends downward from the opposing underside of the tubular main section.

3. The crane assembly of claim 2, wherein a portion of the projection extends in a direction that is substantially parallel with the length of the boom.

4. The crane assembly of claim 3, wherein the end of the projection includes a lip.

5. The crane assembly of claim 4, wherein the lip is bulbous.

6. The crane assembly of claim 5, wherein a section of the projection where the projection extends downward from the opposing underside of the tubular main section is wider than the portion of the projection that extends in the direction substantially parallel with the length of the boom.

7. The crane assembly of claim 6, further comprising:

a block comprising a second sheave upon which the cable is received, and wherein the hook is coupled to the block.

8. The crane assembly of claim 7, wherein the boom comprises a second-stage extension configured to slide from within the tubular extension section; and wherein the projection extends from the main section of the boom.

9. The crane assembly of claim 1, wherein the projection extends downward from the opposing underside of the tubular main section.

10. The crane assembly of claim 9, wherein the hook hangs below the opposing second end on the opposing underside of the tubular main section when in an operational configuration.

11. The crane assembly of claim 10, wherein the projection includes a first portion extending downward from the opposing underside of the tubular main section, a second portion extending from the first portion and curving away from the end of the boom opposite to the main body, and a third portion extending from the second portion.

12. The crane assembly of claim 11, wherein the projection includes an open end configured to receive a loop of the hook and facilitate storage of the hook.

* * * * *